US005742232A

United States Patent [19]

Kurahashi et al.

[11] Patent Number: 5,742,232

[45] Date of Patent: Apr. 21, 1998

[54] GLASS BREAKING DETECTION DEVICE

[75] Inventors: Akira Kurahashi, Nukata-gun; Toshio Hayashi, Anjou, both of Japan

[73] Assignee: Nippondenso Co., Ltd., Kariya, Japan

[21] Appl. No.: 503,047

[22] Filed: Jul. 17, 1995

[30] Foreign Application Priority Data

Jul. 18, 1994 [JP] Japan ..... 6-188842

[51] Int. Cl.[6] ..... G08B 13/00

[52] U.S. Cl. ..... 340/550; 340/556; 340/541; 381/56

[58] Field of Search ..... 381/56, 57; 340/565, 340/566, 550, 545, 541; 379/44

[56] References Cited

U.S. PATENT DOCUMENTS

| | | | |
|---|---|---|---|
| 4,060,803 | 11/1977 | Ashworth, Jr. | 381/56 |
| 4,091,660 | 5/1978 | Yanagi | 340/550 |
| 4,134,109 | 1/1979 | McCormick et al. . | |
| 4,668,941 | 5/1987 | Davenport et al. | 340/550 |
| 4,837,558 | 6/1989 | Abel et al. . | |
| 4,853,677 | 8/1989 | Yarbrough | 340/566 |
| 5,117,220 | 5/1992 | Marino et al. | 340/550 |
| 5,185,593 | 2/1993 | Du Rand | 340/566 |
| 5,192,931 | 3/1993 | Smith et al. | 340/550 |
| 5,229,748 | 7/1993 | Ehriner et al. . | |
| 5,323,141 | 6/1994 | Petek | 340/550 |
| 5,414,409 | 5/1995 | Voosen et al. | 340/550 |
| 5,438,317 | 8/1995 | McMaster | 340/550 |
| 5,450,061 | 9/1995 | McMaster | 340/550 |
| 5,471,195 | 11/1995 | Rickman | 340/550 |
| 5,510,767 | 4/1996 | Smith | 340/550 |
| 5,515,029 | 5/1996 | Zhevelev et al. | 340/550 |
| 5,543,783 | 8/1996 | Clark et al. | 340/550 |
| 5,552,770 | 9/1996 | McMaster | 340/566 |

FOREIGN PATENT DOCUMENTS

| | | |
|---|---|---|
| 58-35457 | 3/1983 | Japan . |
| 3-72258 | 3/1991 | Japan . |
| 2027242 | 2/1980 | United Kingdom . |
| 2284668 | 6/1995 | United Kingdom . |
| 2222583 | 8/1995 | United Kingdom . |
| WO 93/10513 | 5/1993 | WIPO . |
| WO 95/01621 | 1/1995 | WIPO . |

*Primary Examiner*—Curtis Kuntz
*Assistant Examiner*—Xu Mei
*Attorney, Agent, or Firm*—Cushman, Darby & Cushman IP Group of Pillsbury Madison & Sutro LLP

[57] ABSTRACT

A first wave of a glass breaking sound has a sharp peak due to an impact sound and thereafter it attenuates rapidly. The attenuating characteristics of the first wave is measured with an attenuating time or a magnitude of attenuation thereof so that whether or not glass breaking has occurred is determined. Since an original waveform obtained by a microphone includes noise, low frequency components are eliminated by a high pass filter. The characteristics of the first wave of the glass breaking sound is almost stable. Therefore, by detecting the characteristics from the first wave, the glass breaking can be detected without errors. Further, since the glass breaking is detected by attenuation of the first wave, the detection can be carried out quickly.

4 Claims, 11 Drawing Sheets

GLASS BREAKING DETECTION DEVICE

CROSS REFERENCE TO RELATED APPLICATION

This application is based on and claims priority from Japanese Patent Application No. 6-188842 filed Jul. 18, 1994, the contents of which are incorporated herein by reference.

BACKGROUND OF THE INVENTION

1. Field of the Invention

The present invention relates to a glass breaking detection device detecting a breaking of glass such as an automotive window and producing a detection signal, and especially relates to a glass breaking detection device detecting glass breaking by using sound thereof.

2. Related Art

FIG. 2 illustrates a typical waveform of glass breaking sound. A sound signal turns to be an alternating waveform because of a characteristic of a microphone as a sound electric transducer and a property of sound. An origin of coordinate in FIG. 2 does not agree with a moment when a glass receives an impact. A time when waveform starts vibrating is the time when destruction of the glass starts by the impact. A vertical axis indicates voltage of an electric signal corresponding to the glass breaking sound detected by the microphone. Since the values depend on characteristics of the microphone and an amplifier, values according to a system used by the inventors are described in FIG. 2.

As shown in FIG. 2, in general, the glass breaking sound is known to have two waves in which a first wave (a first impact wave) produced when a hard object enough to break a glass collides with the glass and a second wave produced when the glass is broken into pieces.

Conventionally, as a method of a glass breaking detection, various kinds of methods of the glass breaking detection have been proposed in the United States where car theft has been a problem. For example, devices disclosed in U.S. Pat. No. 4,134,109, No. 4,853,677 and No. 4,837,558 are known and an example of a glass breaking detection is also disclosed in PCT Japanese Patent Application Laid-open No. Hei. 4-500727. The devices will be briefly described hereafter.

(a) Glass breaking sound is obtained with a pattern of the first wave and the second wave, a circuit is operated with the first wave as a trigger, the second wave is analyzed with respect to its frequency by a plurality of frequency filters and whether or not a voltage level of each frequency band exceeds a predetermined threshold is determined to detect the glass breaking.

(b) Changes in atmospheric pressure due to the glass breaking sound (for example, from 3 to 4 kHz) and due to an opening of a window of a door (for example, from 1 to 2 Hz) are detected and a glass breaking detection signal is generated based on an output from OR gate to which two signals corresponding to the detected pressure changes are provided.

(c) Using a piezoelectric element, sound from 4 to 8 kHz is detected. When a level of the sound is larger than a predetermined threshold, the glass breaking detection signal is output.

(d) An ultrasonic wave band exceeding 100 kHz is monitored and when the monitored level is larger than the predetermined threshold, the glass breaking detection signal is output.

A method analyzing a frequency signal of the glass breaking sound with using the first wave and the second wave is employed in U.S. Pat. No. 4,134,109, while in the other prior arts, a signal level in a specified frequency band is detected from analysis of whole wave frequency regardless of the first wave and the second wave. In any prior art of the glass breaking detection, although each frequency band is different, when a level of detected sound is larger than the predetermined threshold, the glass breaking detection signal is output. However, since frequency component of the glass breaking sound itself is changed by its way of breaking, it is very difficult to determine the threshold in a certain frequency band beforehand. Thus, when the determination of the glass breaking used for without adjusting the threshold, detection errors are increased undesirably.

SUMMARY OF THE INVENTION

It is a purpose of the present invention to provide a glass breaking detection device decreasing detection errors by detecting glass breaking not by detecting a level of frequency component of glass breaking sound changing in different conditions but with making use of characteristics of attenuating sound in the glass breaking sound.

A glass breaking detection device outputting a determination signal of the glass breaking comprises converting means for converting a glass breaking sound into an electric signal, a high pass filter cutting off a signal having frequency lower than predetermined frequency of the electric signal and breaking determination means for determining the glass breaking in response to attenuating characteristics of a first impact wave of the glass breaking sound as an output signal of the high pass filter.

Further, the breaking determination means can determine the glass breaking based on a relative comparison with respect to level of the first impact wave and elapsed time after detecting the first impact wave. In addition, the breaking determination means can include largest peak detection means for detecting a largest peak value of a signal voltage of the first impact wave, smoothing means for smoothing the output signal of the high pass filter and signal level determination means for determining the glass breaking when the output signal of the smoothing means falls below a level defined as a predetermined fraction of the largest peak value, within a predetermined time period after detecting the largest peak value by the largest peak detection means.

Furthermore, the breaking determination means can include largest peak detection means for detecting a largest peak value of a signal voltage of the first impact wave, smoothing means for smoothing the output signal of the high pass filter and signal level determination means for determining the glass breaking when elapsed time between a time when the largest peak value is detected by the largest peak detection means and a time when the output signal of the smoothing means falls below a level defined as a predetermined fraction of the largest peak value is shorter than a predetermined time period.

The breaking determination means can include a largest peak detection means for detecting a largest peak value of a signal voltage of the first impact wave, latest peak detection means for detecting a latest peak value among many peaks included in the first impact wave against the elapsed time and signal level determination means for determining the glass breaking when the latest peak value detected by the latest peak detection means falls below a level defined as a predetermined fraction of the largest peak value within a predetermined time period after the largest peak value is detected by the largest peak detection means. Furthermore, the breaking determination means can include largest peak detection means for detecting a largest peak value of a signal voltage of the first impact wave, latest peak detection means for detecting a latest peak value among many peaks included in the first impact wave against the elapsed time, and signal level determination means for determining the glass breaking when the elapsed time between a time when the largest peak value is detected by the largest peak detection means and a time when the latest peak value detected by the latest peak detection means falls below a level defined as a predetermined fraction of the largest peak value is shorter than a predetermined time period. The breaking determination means can have determination limitation means for allowing a determination for the glass breaking only within a specified time period after a level of the electric signal before it is provided to the high pass filter exceeds a predetermined reference level.

The first wave in the glass breaking sound has attenuation characteristics characterized by a sharp peak due to an impact sound and rapid attenuation after the sharp peak. The characteristics is necessarily produced in the glass breaking sound and the first wave shows a characteristic waveform. The attenuation characteristics is measured by an attenuating time or a magnitude of an attenuation of the signal value, and whether or not the glass breaking has occurred is determined. Since original first wave includes a component interrupting the above determination, the first wave having a signal component where a low frequency component as a noise component is removed by the high pass filter is used to determine the glass breaking. A signal component obtained by removing a high frequency component of the first wave can be used for the determination if necessary.

The glass breaking sound is characterized by that the attenuation characteristics of the first wave is almost independent from an environment where the glass is in use and a material or shape of the hard object breaking the glass. Therefore, by detecting the characteristics from the attenuation characteristics of the signal component passing through the high pass filter, the glass breaking can be detected with minimized errors. Further, as soon as the glass receives an impact the glass breaking is detected based on the attenuation characteristics of the first wave, and therefore, the detection can be carried out at the earliest possible time.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

The present invention will be described in detail with reference to the accompanying drawings.

Figure 1:
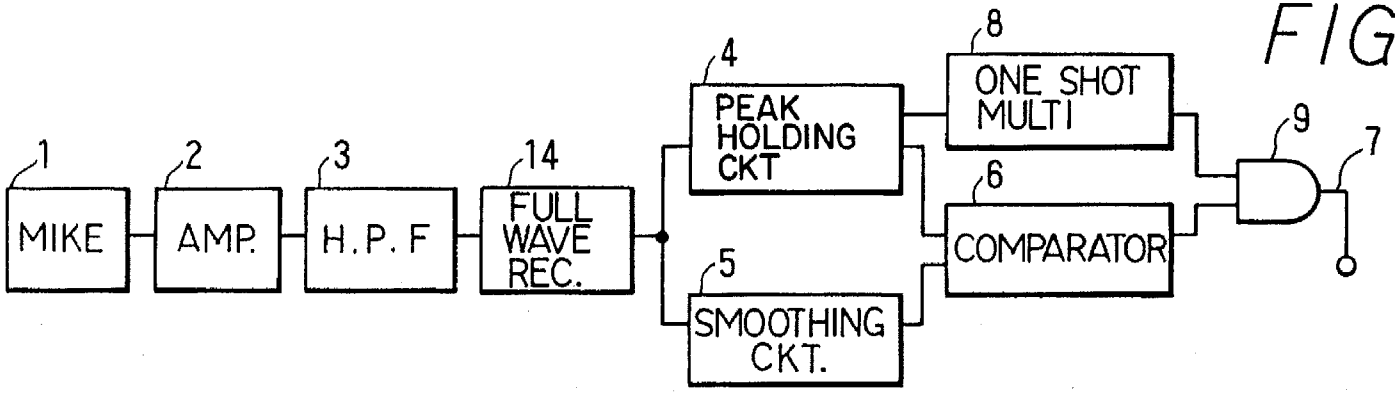
FIG. 1 is a block diagram illustrating a glass breaking detection device according to a first embodiment of the present invention.

FIG. 1 is a block diagram of a glass breaking detection device according to a first embodiment of the present invention. A low frequency component of a signal from a microphone 1 detecting glass breaking sound is cut off by passing through a high pass filter (HPF) 3 through an amplifier 2, and thereafter, the signal is input to a peak holding circuit 4 holding a largest value and to a normal smoothing circuit 5 after full wave rectified by a rectification circuit 14. The peak holding circuit 4 outputs a value of a predetermined fraction (for example, 1/10) of the held largest peak value to a comparator 6. The value becomes one of reference values for a determination of a glass breaking. An output of the smoothing circuit 5 indicates an attenuation value of detected sound. The comparator 6 compares two output values to determine whether or not the values correspond to attenuation characteristics of the glass breaking. It is clear from a result of experiment by inventors that the first wave of the glass breaking (the first impact wave) is attenuated in 20 ms after the largest peak value is produced. Therefore, a one-shot multivibrator 8 triggered by the peak holding circuit 4 is installed to carry out the determination of the glass breaking within 20 ms. That is, the one-shot multivibrator 8 outputs a pulse with width corresponding to 20 ms to an AND gate 9 responsive to the trigger by the peak holding circuit 4. The pulse with width of 20 ms makes it possible that an output signal from the comparator 6 passes through the AND gate 9. Therefore, after the pulse is terminated, the output signal from the comparator 6 is interrupted by the AND gate 9, and thereby, the glass breaking detection signal is not produced on an output terminal 7 accidentally.

The amplifier 2 connected to the microphone 1 can have amplification rate corresponding to characteristics of the microphone 1 but can be omitted if not necessary.

By removing a predetermined low frequency component from the first impact wave of the glass breaking second, the glass breaking can be accurately and stably determined. For this reason, only a high frequency component, for example, more than 6 kHz in the signal after amplification is extracted by the HPF 3 and the largest peak value of the signal where only the high frequency component is extracted is held in the peak holding circuit 4. Change of the signal after the HPF 3 is averaged by the smoothing circuit 5 to eliminate a high frequency wave noise and thereby the smoothing circuit 5 outputs a stabilized attenuation signal. When the attenuation signal becomes, for example, 1/10 of the largest peak value, the output of the comparator 6 reverses and the glass breaking signal is output from the AND gate 9 to the output terminal 7. When the peak holding circuit 4 is constructed so that it has a function for counting a constant time period and holds the largest peak value for 20 ms, the glass breaking can be detected without using the one-shot multivibrator 8 and the AND gate 9.

Detection of the largest peak value in the peak holding circuit 4 can be carried out either by using a zero-to-peak method to the signal voltage after full wave rectifying or by using a peak-to-peak method to the signal voltage before full wave rectifying. In the zero-to-peak method, since all signal values become positive after the full wave rectifying, the peak value is always positive. Thus, since an obtained voltage range is doubled, a very accurate detection can be carried out. Since each construction of the peak holding circuit 4 and the smoothing circuit 5 is widely known in the field of an electric circuit, a detailed explanation is omitted.

In the block diagram of FIG. 1, although the HPF 3 is used for a filtering processing, a BPF (band pass filter) can be used instead as long as a predetermined low frequency component is eliminated. That is the same in the other embodiments to follow. Further, the full wave rectification circuit 14 is disposed after the HPF 3 and after the signal value is changed to its absolute value, the signal value is input to the peak holding circuit 4 and the smoothing circuit 5. However, the full wave rectification circuit 14 can be omitted when the peak-to-peak method is used (the full wave rectification circuit is not shown in other figures).

Above-described circuit (the block diagram in FIG. 1) shows a construction to compare the largest peak value with the average value after certain elapsed time generated by the smoothing circuit 5. However, when comparing the largest peak value and a peak value of a signal waveform after certain elapsed time, instead of the smoothing circuit 5, a second peak holding circuit is used. Holding time obtained by the second peak holding circuit is set shorter than the holding time obtained by the peak holding circuit 4 and a latest peak value is held in the second peak holding circuit and compared with the largest peak value in the comparator 6. Therefore, the comparison of peak values is hardly affected by noises that are produced regularly.

No matter what the first impact wave of the glass breaking is, the first impact wave is attenuated within 20 ms.

Figure 2:
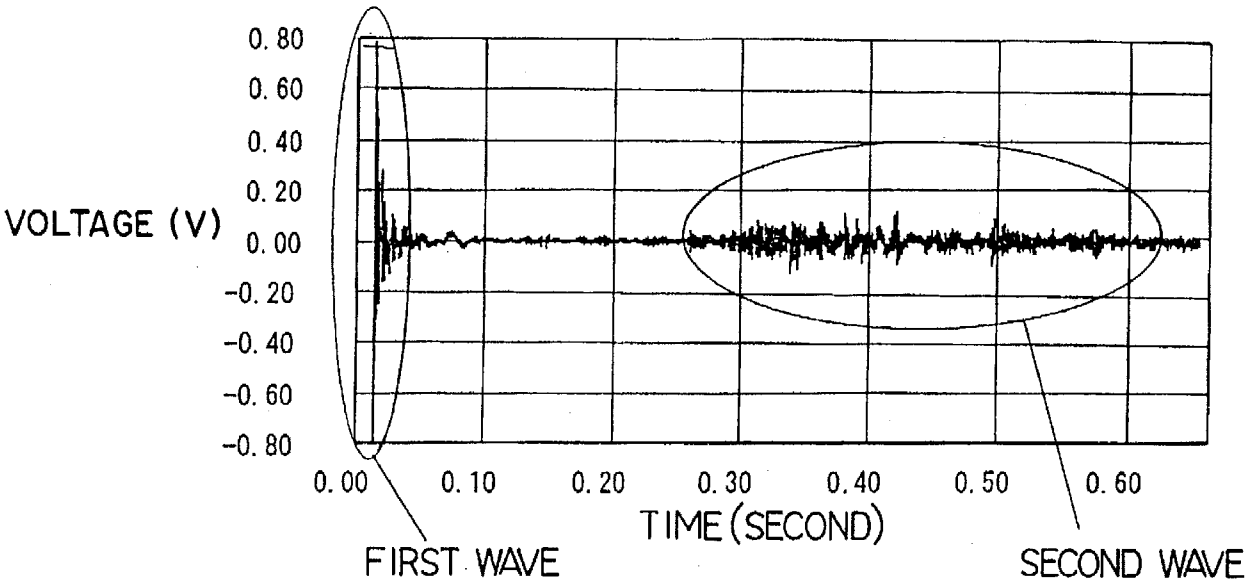
FIG. 2 is a time chart illustrating a waveform of typical sound of glass breaking.

As shown in FIG. 2, sound produced at the glass breaking includes the first impact wave (the first wave) and the second wave produced when glass is broken into pieces. The first impact wave usually produces very large sound pressure and the first impact wave becomes more outstanding level of signal than a background sound level. In 60 samples obtained by using various kinds of glasses and different impact tools, FIG. 3B indicates distribution of 20 dB (=1/10) attenuating time measured by comparing an initial peak value and the peak values (the latest peak value) obtained afterwards of an original waveform of the first wave and FIG. 3A indicates distribution of 20 dB attenuating time with regard to a smoothed data obtained by taking a movement average of 5 points among each peak. In FIG. 3B, 90% of all has attenuating time within 20 ms, while in FIG. 3A, all has the attenuating time within 20 ms. Therefore, attenuating waveform of the first wave by glass breaking shows almost the same change. Thus having, for example, 20 ms or 25 ms as a threshold value and detecting 20 dB attenuating time with using the threshold value, the glass breaking can be determined.

Figure 3A:
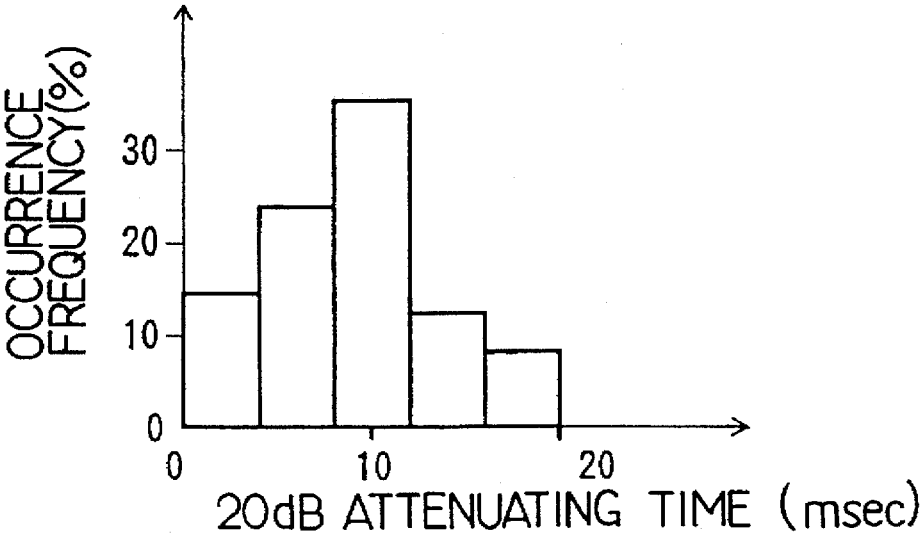
FIG. 3A is a graph illustrating distribution of attenuating time of glass breaking sound obtained by comparing peak value and smoothed waveform.
Figure 3B:
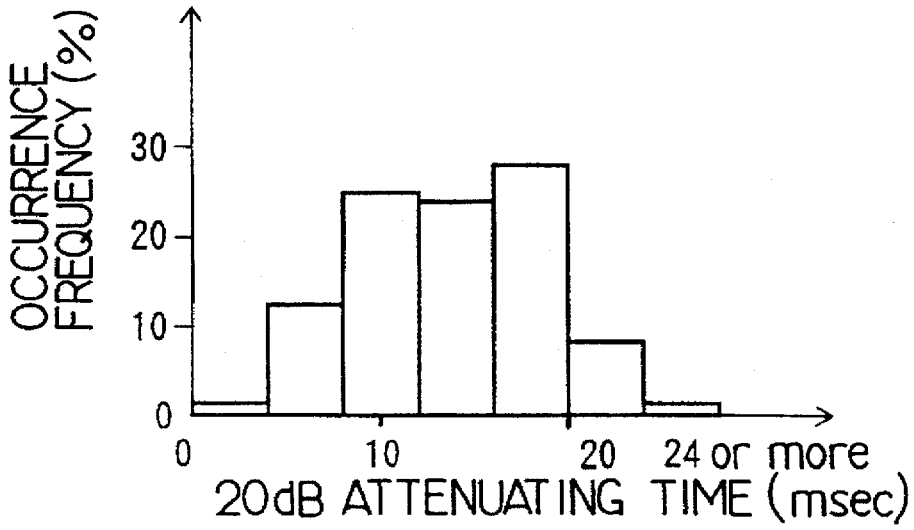
FIG. 3B is a graph illustrating distribution of attenuating time by comparison of peak holding values of original waveform.

However, as a condition that the 20 dB attenuating time distributes as shown in FIGS. 3A and 3B, an unnecessary component included in the signal needs to be omitted. FIGS. 4 through 14 illustrate differences of signal waveforms due to difference of the high pass processing and Table 1 indicates relationships for each figures. A waveform (in FIG. 4) where the output signal from the microphone 1 is only amplified has much noise composed of low frequency components, and therefore, the waveform cannot be used for the signal analysis (signal processing) as it is. What degree of the low frequency component needs to be eliminated to carry out the signal analysis is compared by the HPFs with cut-off frequencies of 2 kHz, 6 kHz and 19 kHz. In a case where the HPF has the cut-off frequency of 2 to 6 kHz, the waveform is adequate to the analysis as shown in FIG. 11. However, when the cut-off frequency is 10 kHz, the largest peak value itself of the waveform is lowered, and hence it is not adequate to measure the attenuating time. Further, in the signal analysis, the determination for the glass breaking can be performed easier when a data with absolute normalization with using the largest peak value and the average value of a plurality of the peak values obtained afterwards is used than when a data with absolute normalization with using the largest peak value and the latest peak value is used.

TABLE 1

Figure 4:
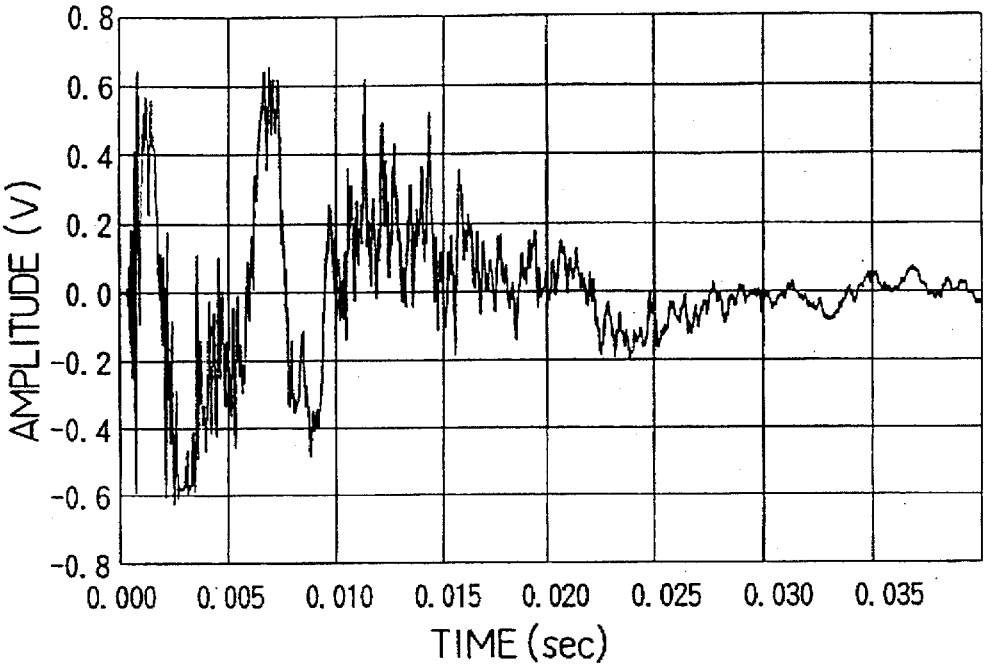
FIG. 4 is a time chart illustrating a signal waveform obtained by a first noise removal process.
Figure 5:
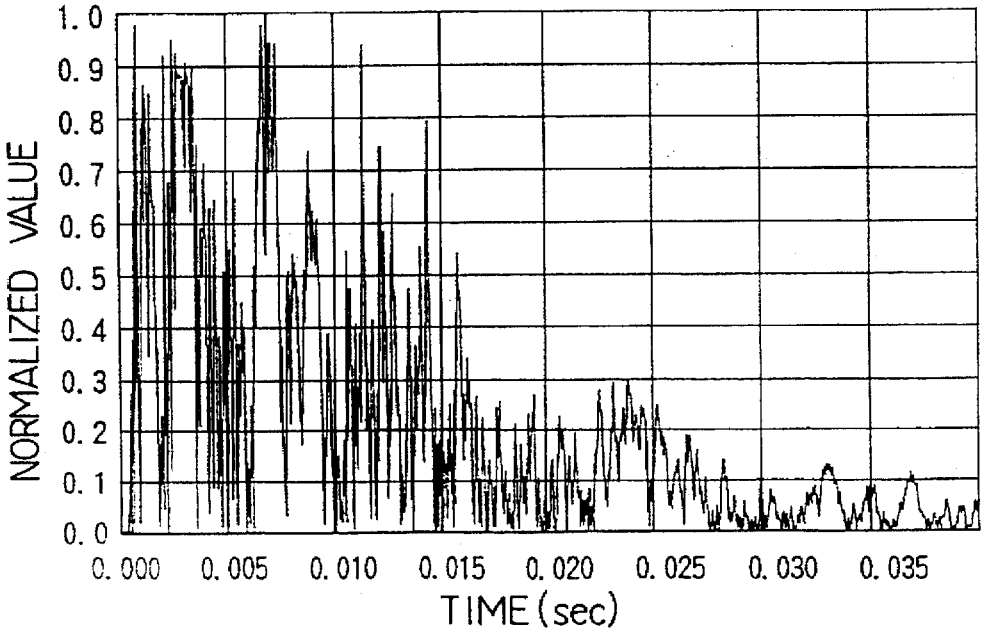
FIG. 5 is a time chart illustrating a signal waveform obtained by a second noise process.
Figure 6:
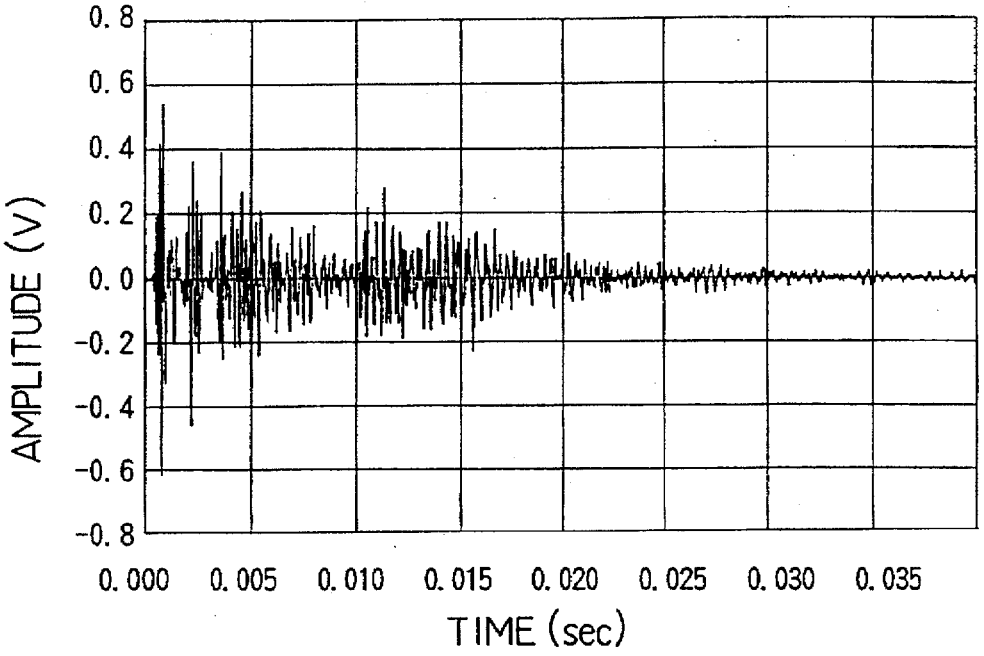
FIG. 6 is a time chart illustrating a signal waveform obtained by a third noise removal process.
Figure 7:
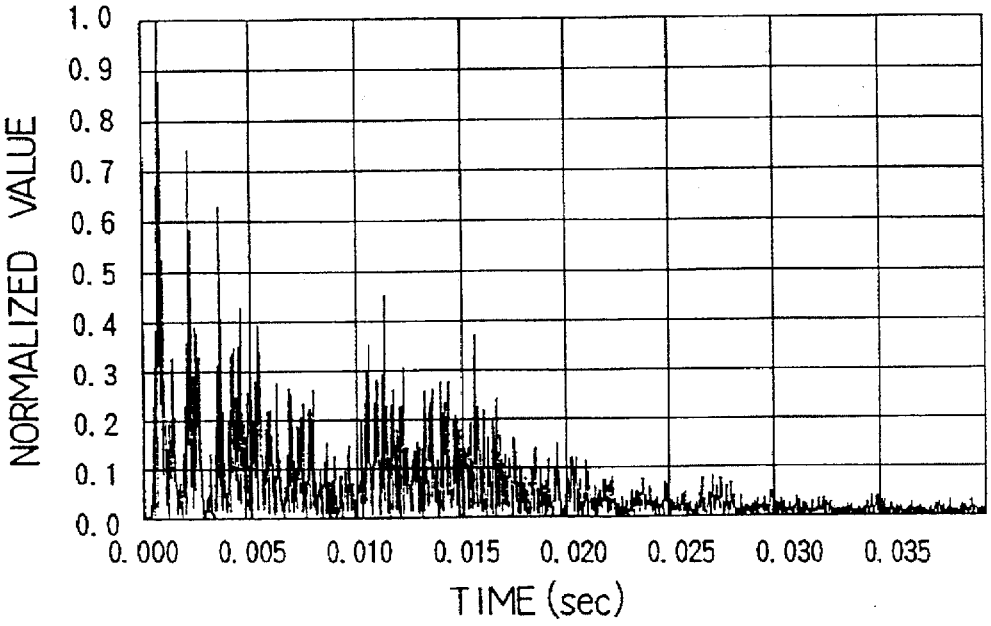
FIG. 7 is a time chart illustrating a signal waveform obtained by a fourth noise removal process.
Figure 8:
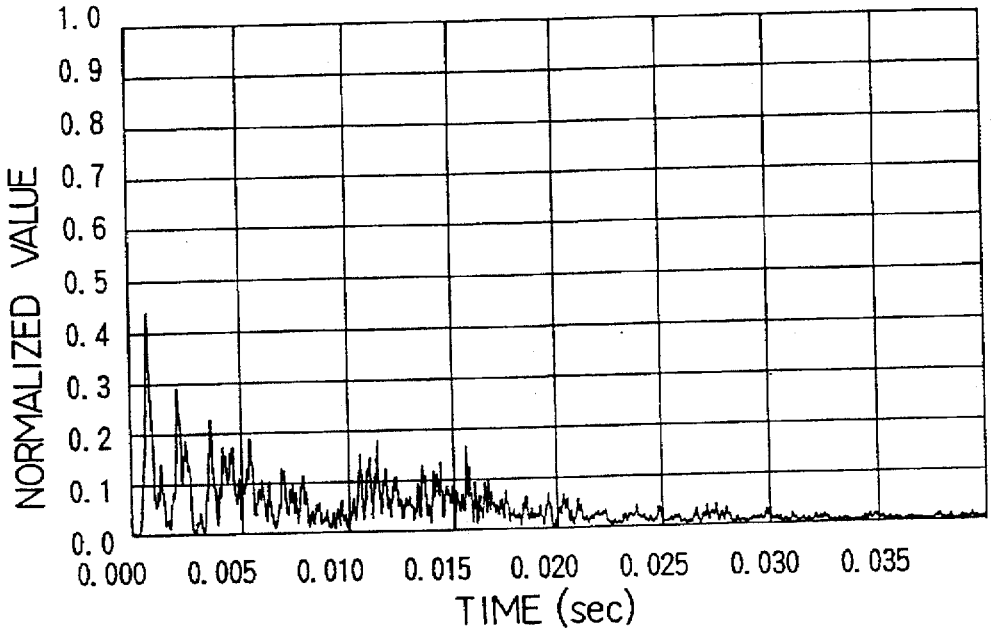
FIG. 8 is a time chart illustrating a signal waveform obtained by a fifth noise removal process.
Figure 9:
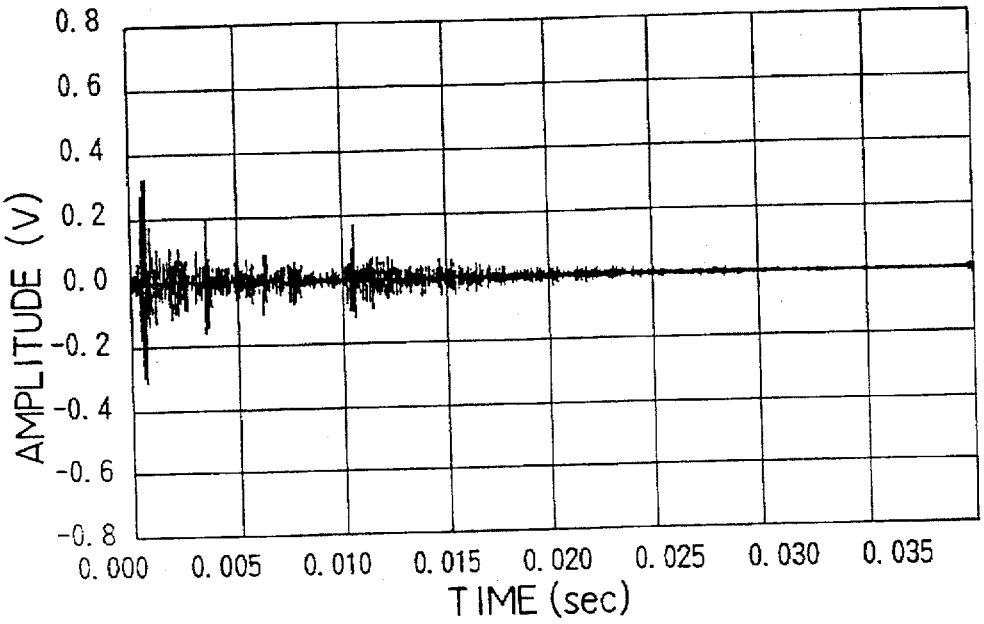
FIG. 9 is a time chart illustrating a signal waveform obtained by a sixth noise removal process.
Figure 10:
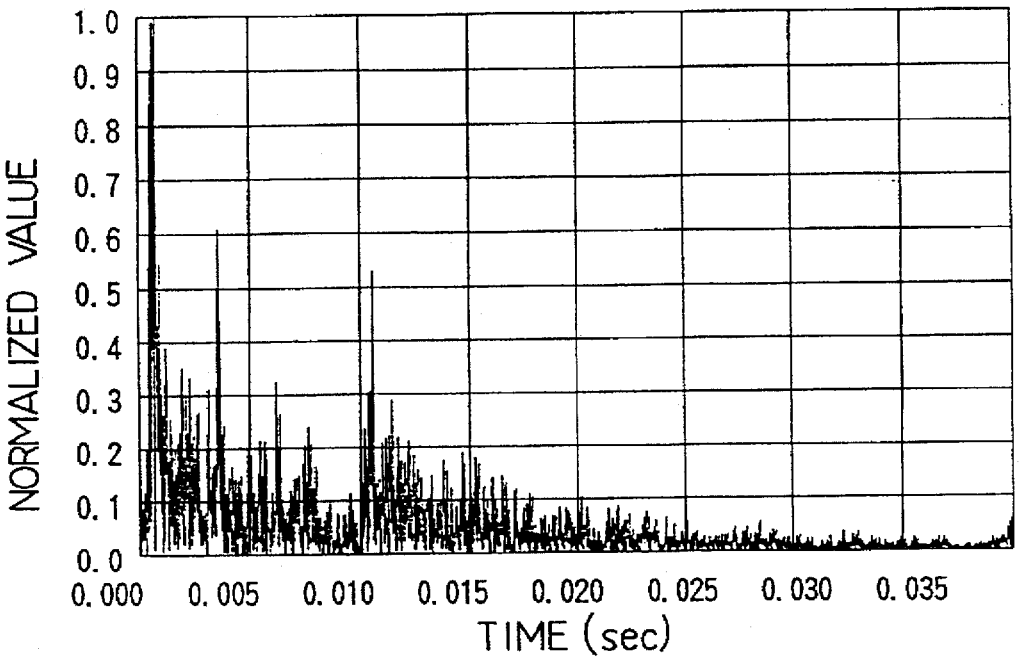
FIG. 10 is a time chart illustrating a signal waveform obtained by a seventh noise removal process.
Figure 11:
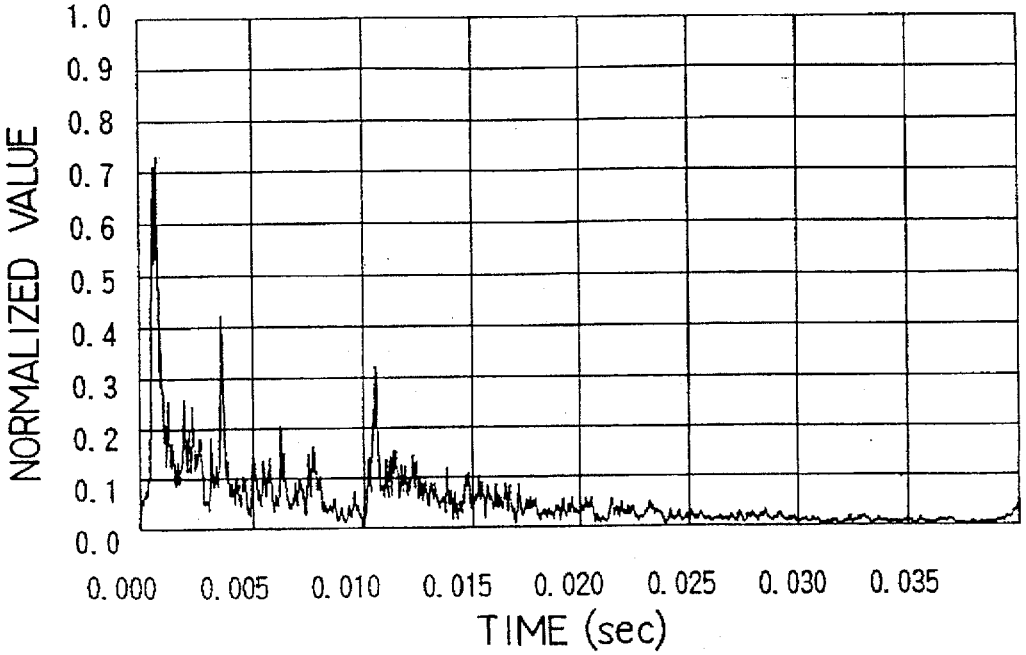
FIG. 11 is a time chart illustrating a signal waveform obtained by a eighth noise removal process.
Figure 12:
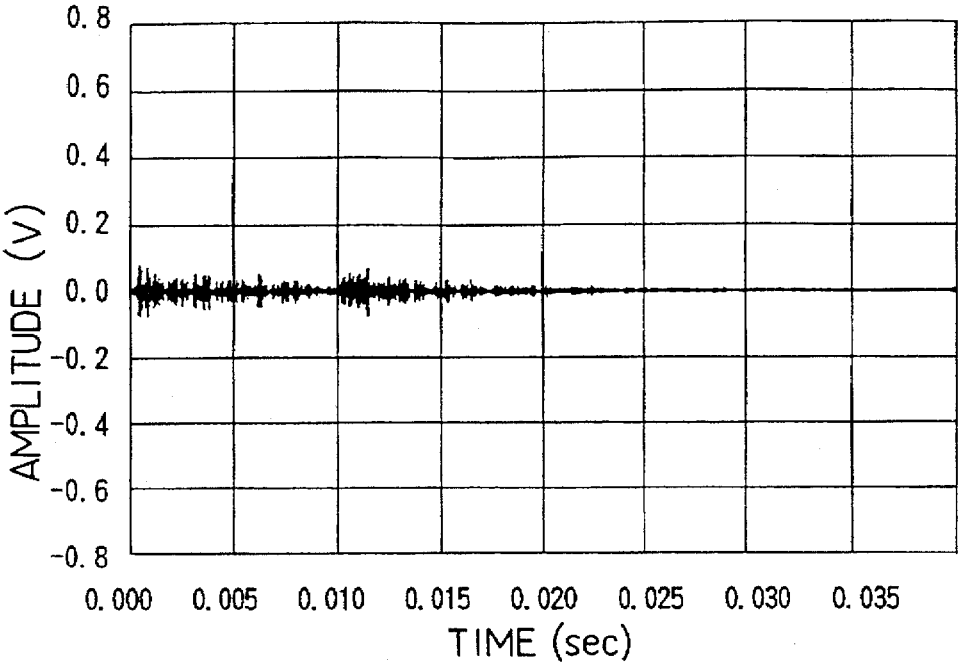
FIG. 12 is a time chart illustrating a signal waveform obtained by a ninth noise removal process.
Figure 13:
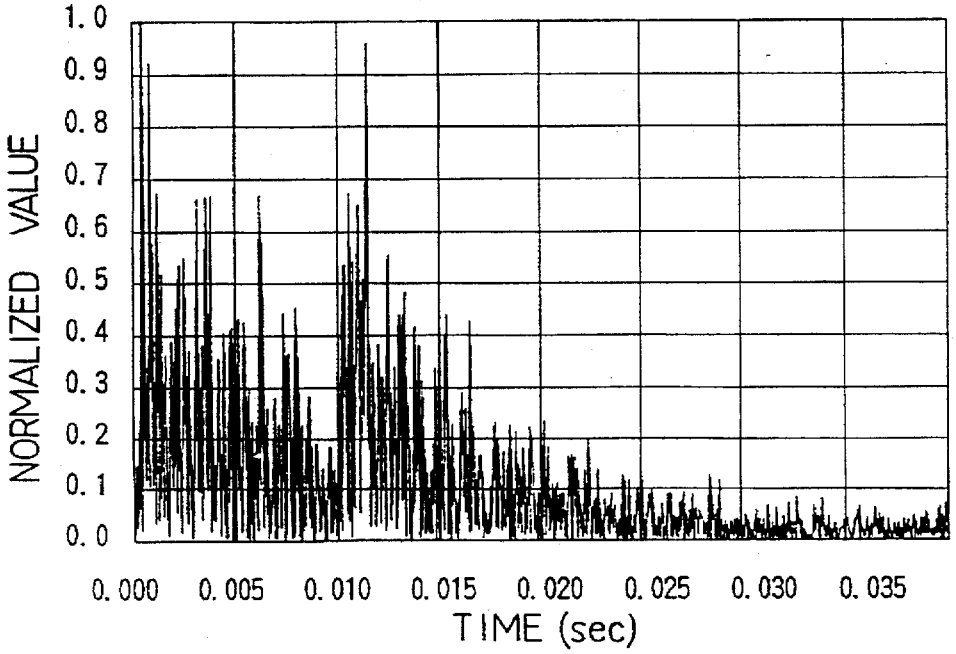
FIG. 13 is a time chart illustrating a signal waveform obtained by a tenth noise removal process.
Figure 14:
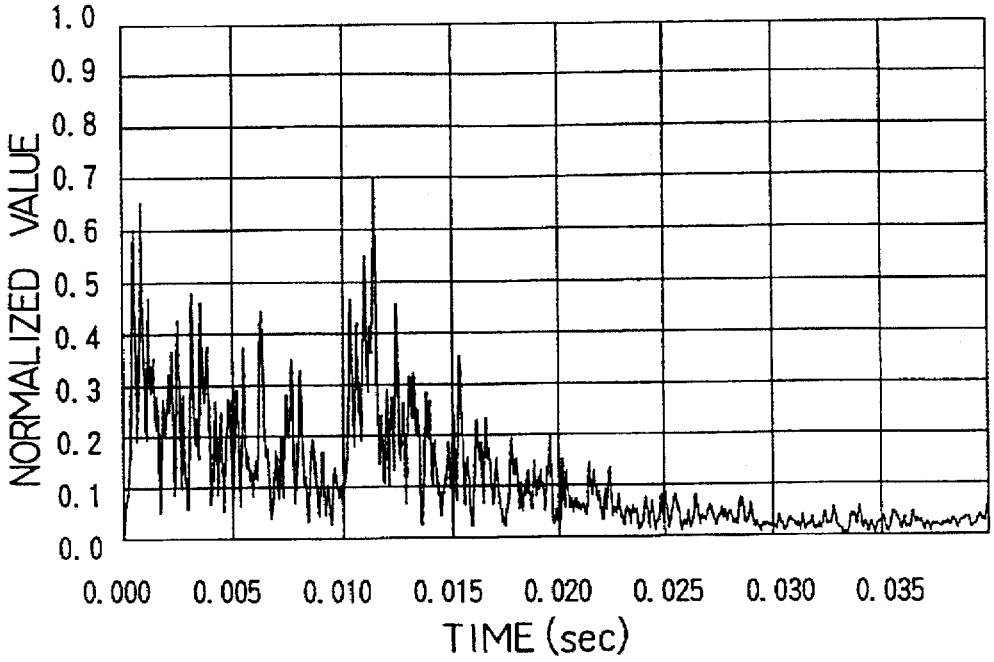
FIG. 14 is a time chart illustrating a signal waveform obtained by a eleventh noise removal process.

| Waveform processing | Waveform | Absolute normalization of the difference between the largest peak value and the latest peak value | Absolute normalization by the largest peak value and a movement average value of the five latest peak values |
|---|---|---|---|
| Original waveform | FIG. 4 | FIG. 5 | |
| waveform after HPF of 2–20 kHz | FIG. 6 | FIG. 7 | FIG. 8 |
| waveform after HPF of 6–20 kHz | FIG. 9 | FIG. 10 | FIG. 11 |
| waveform after HPF of 10–20 kHz | FIG. 12 | FIG. 13 | FIG. 14 |

In Table 2, an influence which the waveform processing has on the attenuating time is assumed as normalization distribution, and average attenuating time and standard deviation of the attenuating time derived based on an actual measured value are shown by each HPF. From the data, a waveform of which low frequency component of 6 kHz or less has been cut off has smallest standard deviation and distribution thereof is ranged smaller. Therefore, for example, measuring attenuating time in a signal of which low frequency component of 6 kHz or less has been cut off, the glass breaking sound can be detected very accurately.

TABLE 2

| Attenuating time measurement waveform | Average attenuating time | Standard deviation of attenuating time |
|---|---|---|
| Waveform when low frequency component of 2 kHz or less is cut off | 16.9 msec | 8.6 msec |
| Waveform when low frequency component of 6 kHz or less is cut off | 14.3 msec | 6.6 msec |
| Waveform when low frequency component of 10 kHz or less is cut off | 17.9 msec | 13.7 msec |

When low cutoff frequency is high, an initial peak value (the largest peak value) is attenuated, while when low cutoff frequency is too low, some of the low frequency component stays behind. Therefore, it is necessary for the low cutoff frequency to be a frequency where the low frequency component can be eliminated for the measurement of the attenuating time and the initial peak level (the largest peak value or the like) is not lowered. For practical use, the frequency is preferably chosen from 2 kHz to 8 kHz.

For the movement average processing of five points, it is not limited to 5 points. Furthermore, employing absolute normalization with using the largest peak value and the latest signal peak value attenuating afterwards, the glass breaking sound can be accurately identified. Therefore, the method of the signal processing which is employed in the glass breaking detection device can be selected corresponding to an environment in which the device is installed.

Furthermore, when the average processing is carried out, for example, using an analog circuit, a smoothing filter can be used, while using a digital circuit, averaging program of measurement voltage can be used. Moreover, an effective value can be substituted.

In the average processing in the digital circuit, an average processing time needs to be set to a time period shorter than the attenuating time of 20 msec. For example, the average processing time is preferably set from 1/10 to 1/100 of the attenuating time. A time constant in the analog circuit is preferably set to the same time period as the one in the digital circuit.

Figure 15:
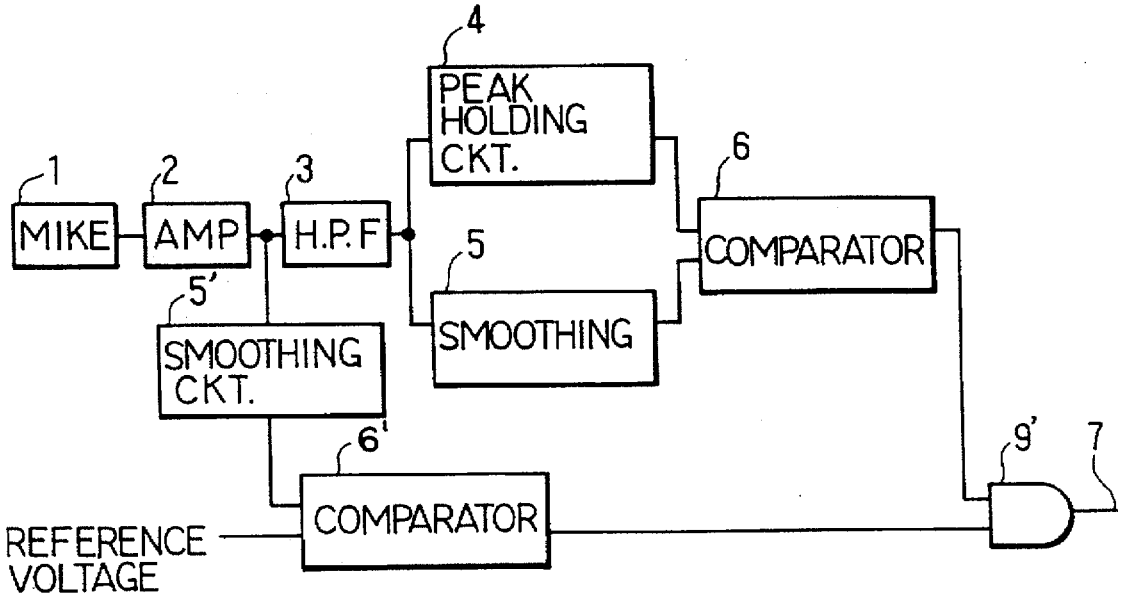
FIG. 15 is a block diagram of a second embodiment of the present invention adding a second smoothing circuit 5', a second comparator 6' and an AND circuit 9'.

FIG. 15 is a block diagram illustrating a structure of the glass breaking detection device according to a second embodiment. The second embodiment includes a second smoothing circuit 5', and a second comparator 6' in addition to the structure of the first embodiment. A predetermined reference voltage and a voltage of the signal smoothed by the second smoothing circuit 5' are compared in these second comparator 6' and only when the signal voltage is more than the predetermined reference voltage, it is determined that the glass breaking has occurred. That is, an impact sound at the glass breaking becomes more than certain degree of loudness, and therefore, an influence of low signal level by background noises can be removed by the above processing. The second smoothing circuit 5' and the second comparator 6' can be replaced with the comparator and the one-shot multivibrator. In this case, when the comparator detects that the signal voltage is larger than a predetermined value, one-shot multivibrator outputs a pulse to an AND gate 9' for a predetermined time period.

Since background noises usually have sound pressure of 60 dB, the signal having a voltage more than the voltage corresponding to the sound pressure can be determined as an abnormal sound (i.e. glass breaking sound). Therefore, by adjusting the reference voltage to the background level corresponding to an environment in which the device is used, the influence by noises can be reduced. The second comparator 6' has a hysteresis characteristics or an output holding function so that the signal voltage of the relatively large first wave produced at the beginning of the glass breaking and the reference voltage are compared. Whether or not the signal is attenuated in a specified interval by the hysteresis or the output holding is determined in another comparator 6, and therefore, whether or not the glass breaks is determined. Even when the signal not passing through the amplifier 2 but through the HPF 3 is input to the second comparator 6', the same result is obtained (not shown in figures).

Figure 16:
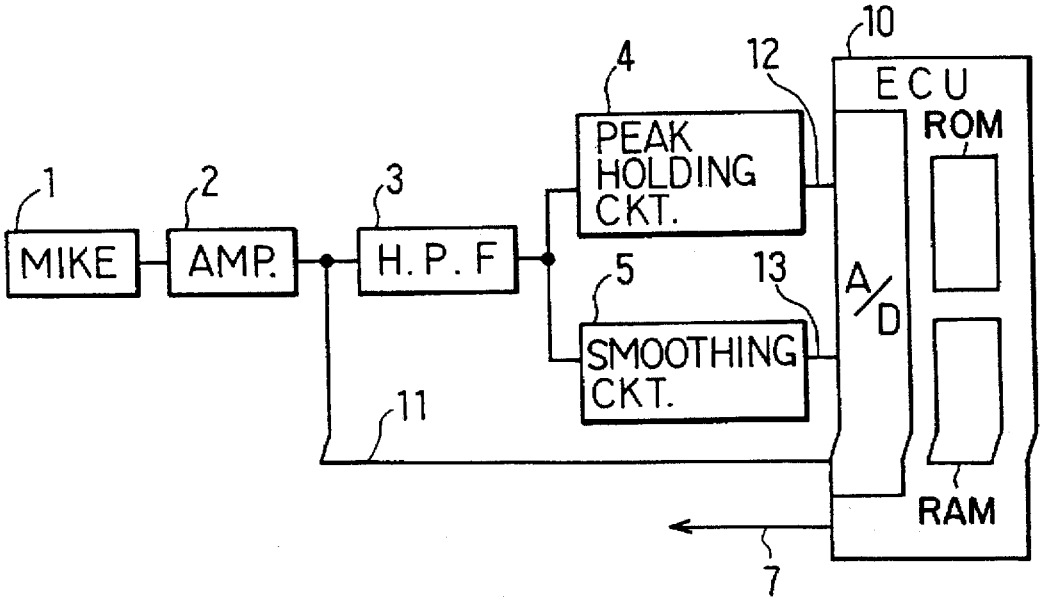
FIG. 16 is a block diagram of a third embodiment of the present invention.

The second comparator 6' in the second embodiment is shown in FIG. 15 as a portion of a block diagram. However, this circuit can be replaced with digital processing by an ECU such as a microcomputer. In this case, it is needless to say that the same effect as the above embodiment is obtained. In FIG. 16, the structure is shown as a third embodiment. A signal 11 of the original waveform including noises after passing through the amplifier 2, a signal 12 held at the peak holding circuit 4 after passing through the HPF 3 and a signal 13 processed in the smoothing circuit 5 are taken in an A/D convertor of the ECU 10 and changed to a digital value. By the process following a flow chart in FIG. 17, whether or not the sound of glass breaking has been generated is determined. The signal 11 according to the original waveform including noise is to form the background level by obtaining the average level thereof.

Figure 17:
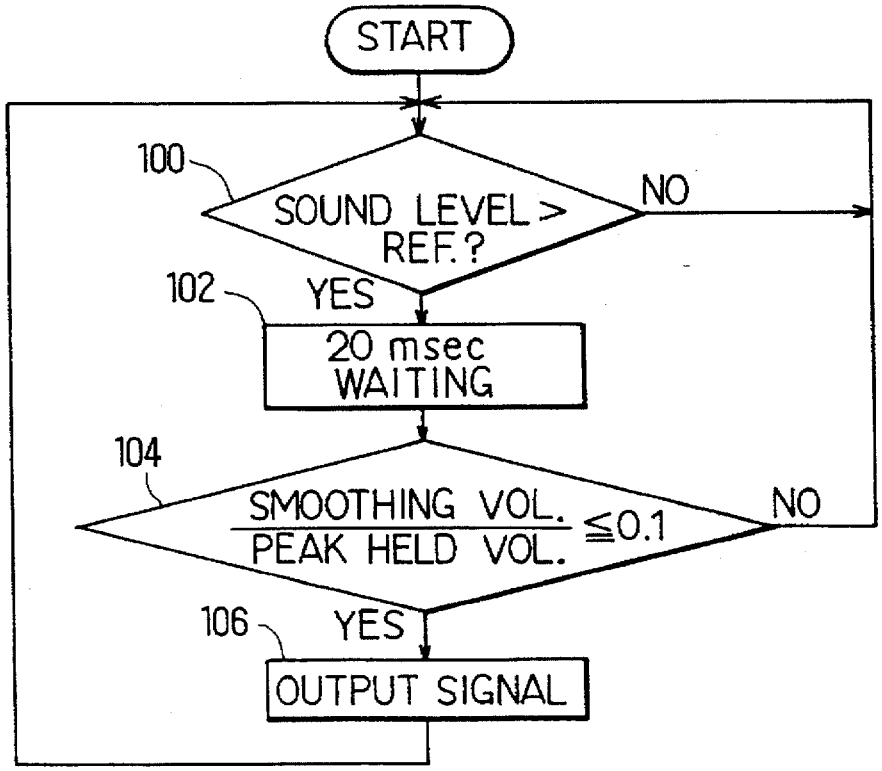
FIG. 17 is a flow chart illustrating signal process in the third embodiment.

The flow chart in FIG. 17 illustrates each step of a main signal processing. Since detection of glass breaking is to be always carried out, the flow chart indicates its process with an endless form. A detailed description of setting an initial condition and determination of an ending condition is omitted, since it can be realized in a programming technique of prior art. Based on a digitized signal data, a voltage of a sound signal provided from the amplifier 2 is determined whether or not it is larger than the reference voltage, that is, the background level, in step 100. When the sound signal is larger than the background level, indicating that some kind of large sound is generated, after waiting for 20 ms (step 102), whether or not a fraction of a voltage of a smoothed signal 13 against voltage of the signal 12 held as a peak value is less than or equal to 0.1 (the signal level is less than 1/10) is determined in step 104. When the sound signal is based on the impact sound caused by the glass breaking, the above-described condition is satisfied. In this case, the glass breaking detection signal is output in step 106 and returns to step 100 in the flow chart. When any condition is not satisfied, the step is repeated from the beginning.

Next, a fourth embodiment is explained.

Figure 18:
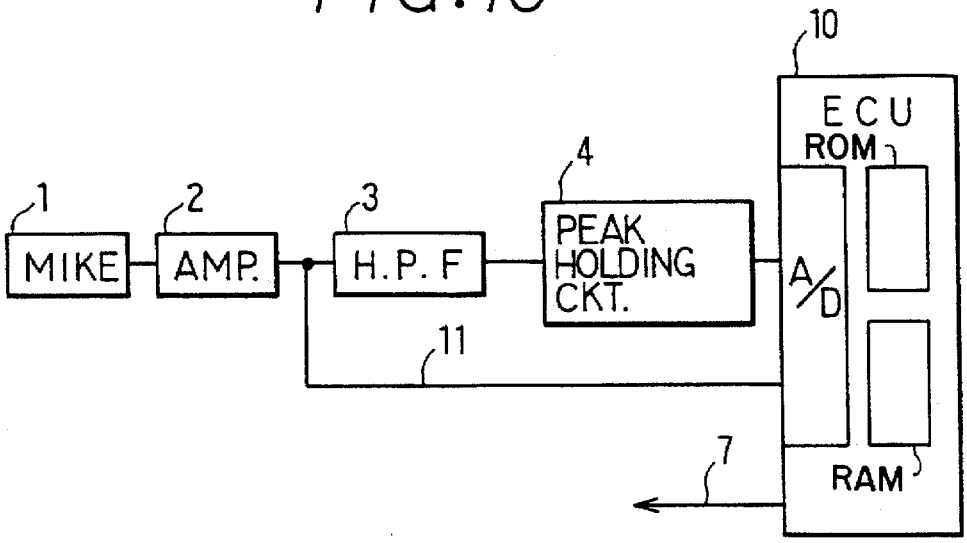
FIG. 18 is a block diagram of a fourth embodiment using only a peak holding circuit in the third embodiment.

In the case of the digital processing as in the third embodiment, only the peak holding circuit 4 may be used as shown in FIG. 18. In this case, holding time of the peak holding circuit 4 is set to short time period and the largest peak value is stored in the ECU 10 immediately after it is held in the peak holding circuit 4. After waiting for 20 ms, an average of each peak value sampled by the peak holding circuit 4 after the largest peak value is calculated. The average value and the largest peak value are compared and whether or not the glass has broken is determined. A produced impact sound is taken by the microphone 1, signal amplified by the amplifier 2 is input to the ECU 10 directly and input to the peak holding circuit 4 through the HPF 3. A time constant (a holding time) of the peak holding circuit 4 is set to short time period. The holding time can be reset by the signal from the ECU 10.

Figure 19:
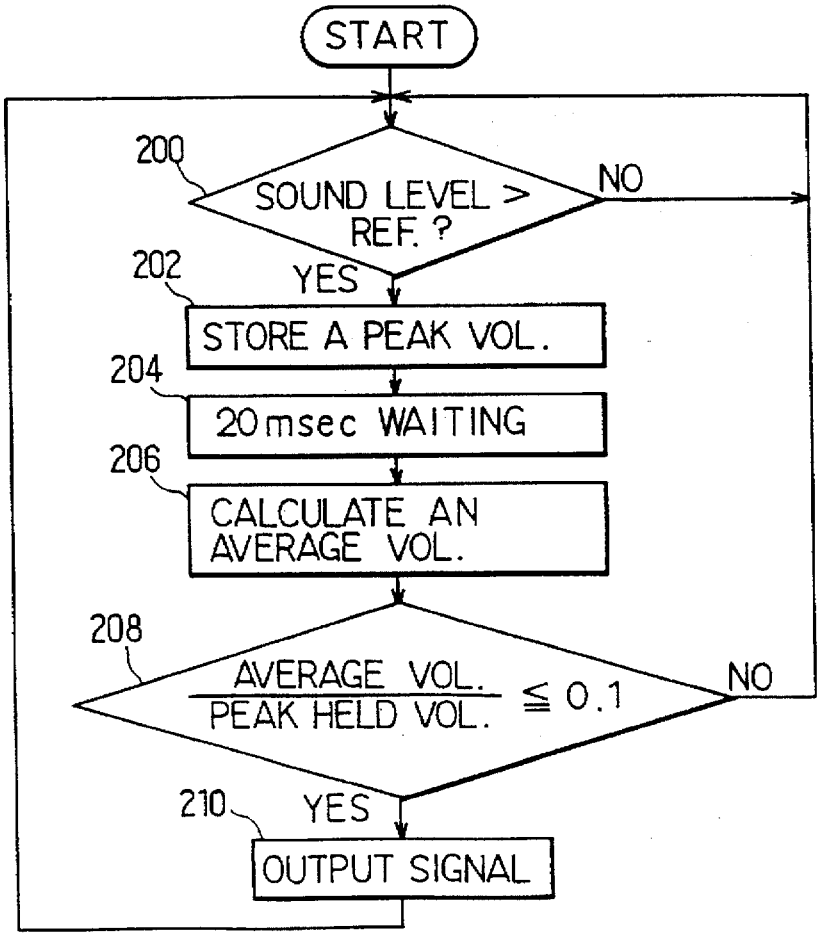
FIG. 19 is a flow chart of the fourth embodiment making a holding time shorter by reducing time constant of the peak holding circuit and short holding time.

FIG. 19 is a flow chart illustrating processing performed by the ECU 10. Just like the third embodiment, only main processing is described. Based on the sound signal after passing through the amplifier 2, whether or not a sound pressure level of the sound signal is larger than a background level is determined at step 200. When the sound pressure level is larger, the largest value data of the peak value sampled by the peak holding circuit 4 is stored as the largest peak value at step 202. After waiting for 20 ms at step 204, the peak values held by the peak holding circuit 4 are sampled and averaged at step 206. Whether or not the averaged peak value (voltage signal) is less than or equal to 1/10 of the largest peak value is determined at step 208, and the glass breaking detection signal is output at step 210 when the determination at step 208 is affirmative. Thereafter the processing returns to step 200. When the determination is negative, the processing starts from the beginning.

Next, a fifth embodiment is explained.

Figure 20:
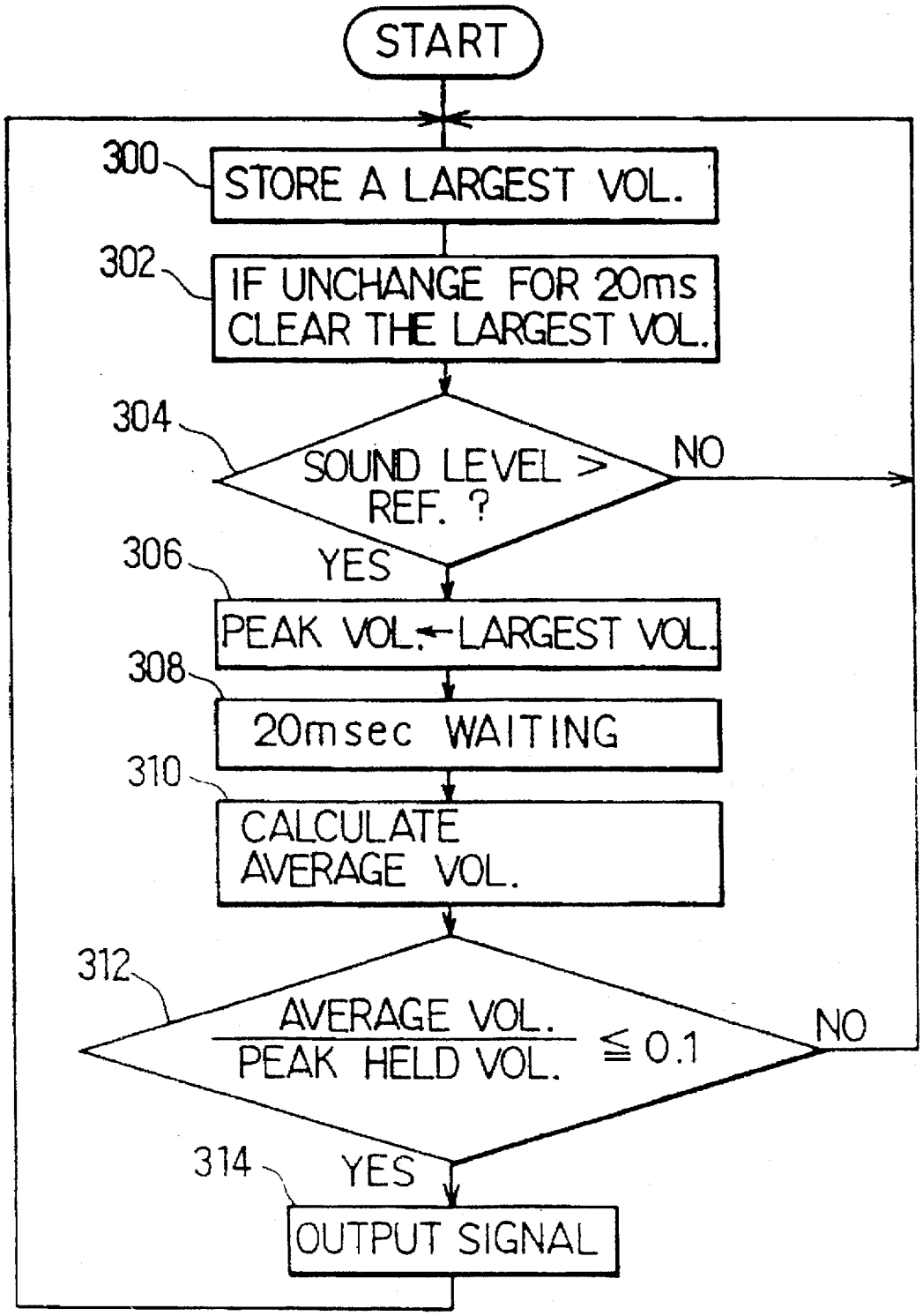
FIG. 20 is a flow chart of a fifth embodiment in a case of operating function of the peak holding circuit by the CPU.

In a circuit shown in FIG. 18, a function of the peak holding circuit 4 can be processed in the ECU 10. A flow chart shown in FIG. 20 carries out the process of the peak holding by a software. That is, a largest value recognized as a peak value at step 300 is always detected with a short sampling period and stored. Preferably, the step 300 should not be included in the main routine shown in FIG. 18 but should be carried out by an interruption processing according to a time sharing method. Whether or not the largest value stored as the peak value is larger than a background noise level, is determined at step 304. When the largest value is larger than the background noise level the present largest value is set as the largest peak value at step 306. After waiting for 20 ms at step 308, the present sound signal is sampled and the average value of the sampled signals is calculated at step 310. Attenuation degree of the signal level is determined at step 312 based on the average value and the stored largest peak value and, if abnormality corresponding to the glass breaking is determined, the glass breaking detection signal is output at step 314. Thereafter, the processing returns to the beginning of all steps. When an occurrence of the glass breaking is not determined, the processing starts from the beginning. Further, in the process, to store the latest largest value all the time, the largest value is needed to be cleared periodically, in other words, the previously stored value is set to zero at each predetermined time period.

In this case, depending on a timing of the sampling of ECU 10, an accurate peak value cannot be detected in some cases. However, since the ECU 10 can sample the peak value of the sound signal at each time period shorter than the attenuating time of the first impact wave, the first impact wave of the glass breaking is not missed and therefore, there is no problem on the practical use. Further, there is an advantage that the peak holding circuit 4 is not needed and the structure can be simplified.

Next, a sixth embodiment is explained.

As shown in FIG. 3A, although each above-described embodiment detects the attenuation of 20 dB within 20 ms by comparing the largest peak value and the smoothed data, the attenuating time is not limited to 20 ms. For example, as shown in FIG. 3B, if the peak value of the original waveform and an attenuating peak value are compared, in attenuating time of 25 ms, most of waveforms indicate the attenuation of 20 dB. Thus, setting attenuating time to 25 ms and omitting the HPF 3 in the above-described embodiments, determination ability itself does not change although a little more determination time is needed. Therefore, by setting the attenuating time to 25 ms the HPF 3 can be omitted in the above-described embodiments (not shown in the figures), and then the glass breaking detection device is formed with a simple structure.

Processing by the ECU 10 in the third, fourth, fifth and sixth embodiments forms determination limitation means along with each circuit construction.

The largest peak value means the largest signal value appeared in the first wave in the impact waves produced when a glass breaks by receiving an impact. Therefore, the latest peak value afterwards means a maximum value caused by high frequency noises or the like when the signal of the first wave is attenuating, and therefore, the latest peak value is different from the largest peak value.

What is claimed is:

1. A glass breaking detection device comprising:

converting means for converting a glass breaking sound into an electric signal;

a high pass filter which cuts off a signal having a frequency less than a predetermined frequency of said electric signal; and breaking determination means for determining said glass breaking in response to attenuation characteristics of said first impact wave included in an output signal of said high pass filter, wherein the determination is based on a relative comparison with respect to the level of said first impact wave and an elapsed time after detecting said first impact wave, said breaking determination means including:

largest peak detection means for detecting a largest peak value of a signal voltage of said first impact wave;

latest peak detection means for detecting a latest peak value against an elapsed time among many peaks included in said first impact wave; and signal level determination means for determining the glass breaking occurrence when said latest peak value detected by said latest peak detection means falls below a level defined as a predetermined fraction of said largest peak value within a predetermined time period after said largest peak value is detected by said largest peak detection means.

2. The glass breaking detection device according to claim 1, wherein said breaking determination means determines the glass breaking occurrence within a time period equal to or less than 25 milliseconds from the time the largest peak value occurs.

3. A glass breaking detection device comprising:

converting means for converting a glass breaking sound into an electric signal;

a high pass filter which cuts off a signal having a frequency less than a predetermined frequency of said electric signal; and breaking determination means for determining the glass breaking occurrence in response to attenuation characteristics of said first impact wave included in an output signal of said high pass filter, wherein the determination is based on a relative comparison with respect to the level of said first impact wave and an elapsed time after detecting said first impact wave, said breaking determination means including:

largest peak detection means for detecting a largest peak value of an output signal of said first impact wave;

latest peak detection means for detecting a latest peak value against an elapsed time among many peaks included in said first impact wave; and signal level determination means for determining said glass breaking when said elapsed time between a time when said largest peak value is detected by said largest peak detection means and a time when said latest peak value detected by said latest peak value falls below a level defined as a predetermined fraction of said largest peak value.

4. The glass breaking detection device according to claim 3, wherein said breaking determination means determines the glass breaking occurrence within a time period equal to or less than 25 milliseconds from the time the largest peak value occurs.

* * * * *